US009153213B2

(12) United States Patent
Storey

(10) Patent No.: US 9,153,213 B2
(45) Date of Patent: Oct. 6, 2015

(54) ADJUSTABLE PLECTRUM

(71) Applicant: David Charles Storey, Albuquerque, NM (US)

(72) Inventor: David Charles Storey, Albuquerque, NM (US)

( * ) Notice: Subject to any disclaimer, the term of this patent is extended or adjusted under 35 U.S.C. 154(b) by 4 days.

(21) Appl. No.: 13/998,476

(22) Filed: Nov. 4, 2013

(65) Prior Publication Data

US 2015/0122105 A1 May 7, 2015

(51) Int. Cl.
*G10D 3/16* (2006.01)

(52) U.S. Cl.
CPC ..... *G10D 3/163* (2013.01)

(58) Field of Classification Search
CPC ..... G10D 3/163
USPC ..... 84/320–322
See application file for complete search history.

(56) References Cited

U.S. PATENT DOCUMENTS

| | | | | |
|---|---|---|---|---|
| 655,959 | A | 8/1900 | Cochrane | |
| 1,184,561 | A | 5/1916 | Napoletano | |
| 5,271,308 | A | 12/1993 | Balog | |
| 5,894,097 | A | 4/1999 | Barry | |
| 7,186,908 | B2 | 3/2007 | Hodesh et al. | |
| 7,265,285 | B2 | 9/2007 | Storey | |
| 7,812,234 | B2 | 10/2010 | Dybas | |
| 2004/0159207 | A1* | 8/2004 | Glyde | 84/322 |
| 2006/0225556 | A1 | 10/2006 | Glyde | |
| 2007/0079685 | A1 | 4/2007 | Mizek | |
| 2008/0110319 | A1 | 5/2008 | Morris | |
| 2010/0263515 | A1 | 10/2010 | Hollin, Jr. | |
| 2011/0265630 | A1 | 11/2011 | McKee | |

* cited by examiner

*Primary Examiner* — Kimberly Lockett
(74) *Attorney, Agent, or Firm* — Kevin Lynn Wildenstein

(57) ABSTRACT

An adjustable pick or plectrum for a stringed musical instrument is characterized by a top grip portion and a bottom tip portion, the top grip portion adapted to matingly receive the bottom tip portion through an engagement means. The top grip portion preferably has at least one slot or channel which is adapted to receive and retain at least one leg from the bottom tip portion. Preferably, each leg has one or more protrusions, so that selective holes or slots in the top grip portion are adapted to selectively receive, engage and retain each protrusion. The pick is adapted for height adjustability and/or angular adjustability as desired by the musician. The height adjustability can be set in selected positions for different flexibilities. It is seen that this pick has a multi use capability, adjustable from a solid pick through several different flexibilities, heights and angles.

19 Claims, 3 Drawing Sheets

ADJUSTABLE PLECTRUM

CLAIM OF PRIORITY

This invention claims priority based upon U.S. Application No. 61/796,130, filed Nov. 2, 2012.

FIELD OF INVENTION

The present invention relates to picks or plectrums which are used in the playing of stringed musical instruments (such as, for example, guitars and mandolins of the lute family). A conventional pick is generally held between the thumb and index finger of one hand and is used to pluck or strum the strings of the musical instrument The tone produced by a stringed musical instrument will vary considerably depending on the stiffness of the pick when used on a musical instrument. A relatively stiff pick will give the audible and physical effect of more attack to the plucked string than a very thin pick. In contrast, a thin pick will more likely produce a softer audible tone regardless of how hard the string is plucked. Further, because of its flexibility, a thin pick tends to brush over the strings.

BACKGROUND OF THE INVENTION

Plectrums (or, "picks" as they are commonly known) are devices which help a user "pick" or strum stringed instruments of the lute family such as a guitar, banjo or mandolin. A problem often arises when a performer needs multiple picks for the different instruments and styles of music he may play during a concert. Often, for example, jazz musicians like a small pick with no flexibility, but will have to change their pick to play an acoustic guitar. Problems also exist with users having larger fingers (e.g., thumbs), which may make a plectrum difficult to use or control while playing a guitar. And, many performers like to use the plectrum at an angle relative to the guitar strings. The present invention is designed to address these and other drawbacks in prior art designs.

Various attempts have been made in the past to provide picks which allow the musician some degree of different picking abilities without having to quickly change between a stiff pick and a soft pick while playing the instrument midstream. For example, U.S. Pat. No. 5,648,622 to Storey discloses a plectrum having a flexible mid portion. With this invention, the scope of flexibility is only within the one primary flexible area of the pick. As another example, U.S. Pat. No. 4,228,719 to Keene discloses a pick with different flexibilities in each playing corner owing to the provision of different sized holes in the corners. However, in order to take advantage of the different flexibilities, it is necessary to rotate the pick in the musician's fingers which is virtually impossible between individual notes, especially during speed picking.

U.S. Pat. No. 2,459,274 to Galetzky discloses a mandolin pick including a rather complicated slide and screw adjustment mechanism for altering the pick's properties. The adjustment mechanism is not suitable for use during a performance and particularly between the playing of individual notes. Finally, U.S. Pat. No. 1,009,403 to Gaynor discloses a picking device having a cup mechanism which when squeezed by the musician alters the flexibility of the pick but only between soft and stiff with no intermediate range or the ability to vary the flexibility gradually or to have no flexibility at all.

It is therefore desirable to be able to shift quickly between the relatively hard and soft tones available from different picks when playing notes on a musical instrument such as a guitar, without having to switch between picks in the middle of a song. The present invention solves this desire. Because of its optional flexible characteristics, the pick according to the present invention is capable of producing both hard and soft tones. Furthermore when the pick of the present invention is extended to its full height, the musician is able to hold the tip section of the pick for a hard gauge, or could let the tip section flex whilst holding the grip section, allowing the tip section to flex. While the present invention refers to the term "height", those of skill in the art will recognize that this is a relative term, so that the present invention may also be "length" adjustable by merely rotating the present invention ninety degrees, so that the term "height" may also be equated with the term "length".

Further, a musician may choose to close off the flexible section altogether by engaging (or, closing) the two halves of the pick together to form a solid, non-flexible pick structure. Likewise, by doing this, the pick becomes smaller. Smaller picks are often preferred by jazz musicians, and in this configuration, the pick of the present invention has a very hard and positive strike of a note on the stringed instrument. Musicians can also open (or, spread apart) the pick effortlessly for flexibility during playing a song on the string instrument.

Those of skill in the art will now come to realize that other advantages exist according to the present invention. For example, because the present pick is height adjustable, musicians with large hands and fingers can elongate the pick to accommodate the size of the musician's fingers. Moreover, some musicians hold a pick at an angle in order to "slice" a note or angle the pick in order to slide over the strings while playing a chord. The adjustment in the pick's angularity in relation to a string on the instrument allows a musician to adjust the pick's tip at an angle relative to the top grip portion. Moreover, the adjustable characteristics (e.g., height-wise and angularly) of the present invention allow many more users to use the present invention comfortably and with confidence.

The present invention was developed in order to overcome these and other drawbacks of the prior devices by providing a single plectrum that is height and/or angular adjustable over the entire spectrum. The present invention may function equivalently as a stiff or thick pick that enables a musician to strike an instrument's strings with a stronger attack. The present invention may also function equivalently as a very thin pick, which allows the musician to brush over a string or strings in order to produce a softer tone. Because of the present invention's angular and height adjustability, the present invention may also function as every pick variation therebetween, and every variation can be made quickly without interruption of the song being played by the musician.

The present invention has been developed in order to overcome these and other drawbacks of the prior art devices by providing an adjustable plectrum having at least a top grip portion that is adapted to receive a bottom tip portion, the bottom tip portion in one embodiment having at least one leg, the leg preferably providing flexible characteristics and a connection means to the top grip portion. Therefore the top grip portion and the bottom tip portion are preferably adjustably connectable and can be configured in several different ways.

These and other objects of the present invention will become apparent to those skilled in the art from the following detailed description of the invention and the accompanying drawings.

SUMMARY OF THE INVENTION

The following summary of the invention is provided to facilitate an understanding of some of the innovative features unique to the present invention, and is not intended to be a full description of variations that may be apparent to those of skill in the art. A full appreciation of the various aspects of the invention can be gained from the entire specification, claims, drawings, and abstract taken as a whole.

It is one object of the present invention to provide a musical instrument pick having a generally triangular shaped body with a broad top grip portion and a narrow bottom tip portion, so that the top grip portion is adapted to receive, engage and retain the bottom tip portion through an engagement means. Preferably, the engagement means is formed from a first engagement means on the top grip portion, and a second engagement means formed on the bottom tip portion. In one embodiment, the first engagement means is preferably a series of slots or channels formed in the top grip portion. The slots or channels have connecting holes or catches. In one embodiment, the second engagement means is preferably at least one protrusion formed on at least one leg of the bottom tip portion. Each connecting hole or catch being formed to receive and retain each protrusion in substantial registration when the top grip portion receives the bottom tip portion through the engagement means.

Because the bottom tip portion legs may have some degree of flexibility, the overall plectrum structure may have a greater degree of flexure. When the pick is held between the thumb and index finger of a musician of the instrument, and the bottom tip portion is used to pluck the instrument strings, the musician can alter the amount of flexibility of the pick by moving the thumb and index finger relative to the pick's intermediate tip portion. Further, because the engagement means is adjustable both in height and/or angle (see e.g., FIGS. 2*a* and 3*a*), the musician can engage (or, close) the two halves in variable degrees, thereby changing the type of flexibility afforded by the pick and as desired by the musician. By closing or engaging the top grip portion and the bottom tip portion closer together, the resulting single pick structure will have little to no flexibility at all. Because of the angular and height adjustability characteristics of the present invention, a musician may now use the plectrum on a stringed instrument in a variety of different circumstances without having to switch out different picks during a song, and instead, may now use a single pick to play a variety of notes and provide audible effects without having to switch to a different pick.

In an alternate embodiment, an optional tip may be connected onto or may be formed on the bottom tip portion. The optional tip may be formed of any type of material, including steel, plastic, nylon, delrin or any other material.

BRIEF DESCRIPTION OF THE DRAWINGS

Other objects and advantages of the invention will become apparent from a study of the following specification when viewed in the light of the accompanying drawing, in which.

This invention relates to an adjustable plectrum which may have the characteristics of being variably flexible to that it is flex adjustable, height adjustable, angular adjustable, and in another embodiment, having little to no flexibility.

The novel features of the present invention will become apparent to those of skill in the art upon examination of the following detailed description of the preferred embodiment or can be learned by practice of the present invention. It should be understood, however, that the detailed description of the preferred embodiment and the specific examples presented, while indicating certain embodiments of the present invention, are provided for illustration purposes only because various changes and modifications within the spirit and scope of the invention will become apparent to those of skill in the art from the detailed description, drawings and claims that follow.

DETAILED DESCRIPTION OF THE PREFERRED EMBODIMENT

The accompanying figures further illustrate the present invention and, together with the detailed description of the preferred embodiment, assists to explain the general principles according to the present invention.

As seen generally in FIGS. 1*a*-5, the present invention is a plectrum or pick 100 having a generally triangular shaped body with a broad top grip portion 1 and a narrower bottom tip portion 2, so that when the top grip portion 1 is selectively coupled with or otherwise engaged with, or coupled to, bottom tip portion 2, a single structure pick 100 is defined or formed.

In one embodiment, the top grip portion 1 is adapted to receive and retain the bottom tip portion 2 through an engagement means to thereby define the pick 100. Preferably, bottom tip portion 2 further has at least one leg 9 formed adjacent to the tip as seen in FIGS. 1*a* and 5*a*.

Figure 1A:
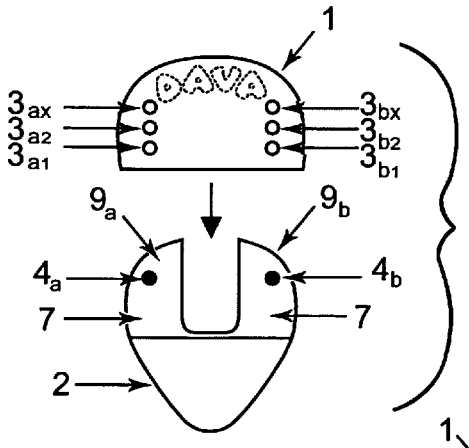
FIG. 1*a* is an exploded illustration of the two-part pick of the invention as the top grip portion may be initially insertable into the bottom tip portion.
Figure 1B:
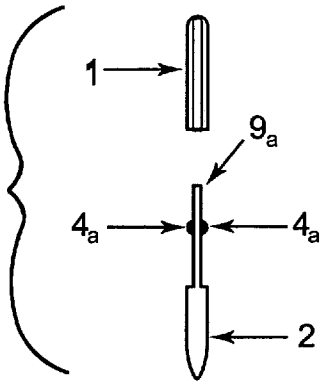
FIG. 1*b* is side view of FIG. 1*a;*
Figure 1C:
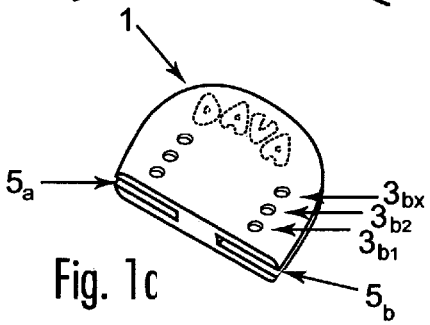
FIG. 1*c* is a bottom side perspective view of the top grip portion illustrating exemplary holes and slots.

FIGS. 1*a*-1*c* illustrate one embodiment of various components of the present invention. In particular, adjustable pick 100 includes a top grip portion 1, and a bottom tip portion 2, the top grip portion 1 being adapted to matingly receive the bottom tip portion 2 through an engagement means. The top grip portion 1 may be defined as a generally semi-circular structure having at least one set of left holes $\mathbf{3}_{a1}$, $\mathbf{3}_{a2}$, $\mathbf{3}_{ax}$ (where x=1, 2, 3, . . . ) and further having at least one set of right holes $\mathbf{3}_{b1}$, $\mathbf{3}_{b2}$, . . . $\mathbf{3}_{bx}$ (where x=1, 2, 3, . . . ) In one embodiment, left holes $\mathbf{3}_{ax}$ are preferably aligned in a straight line, and are formed parallel to the line of right holes $\mathbf{3}_{bx}$ as seen in FIG. 1*a*. Optionally, the front surface structure of top grip portion 1 mirrors the rear surface of top grip portion, so that, for example, left holes $\mathbf{3}_{ax}$ and right holes $\mathbf{3}_{bx}$ are formed both on the front and rear surface of the top grip portion 1. As seen in FIG. 1*c*, top grip portion further includes at least one slot, and preferably, at least two slots 5*a*, 5*b*. The top grip portion's 1 semi-circular surface structure is adapted for a musician to grasp the pick when playing a string musical instrument. Holes $\mathbf{3}_{ax}$, $\mathbf{3}_{bx}$ and slots 5*a*, 5*b* define a first engagement means formed within the top grip portion 1.

The bottom tip portion 2 may be defined by a narrow tip at a far end which is attached to one or more legs (e.g., legs 9*a*, 9*b* in FIGS. 1*a*, 1*b*) at an opposite mating end. As seen in FIG. 1*a*, upon each leg 9*a*, 9*b* may be formed at least one protrusion, nub or bump 4*a*, 4*b*, each protrusion being adapted for selective insertion and mating with a corresponding left or right hole from top grip portion 1. The legs 9*a*, 9*b* are adapted for insertion and mating with corresponding slots 5*a*, 5*b* in top grip portion 1. As such, legs 9*a*, 9*b* and protrusion 4*a*, 4*b* hereafter define an exemplary second engagement means formed on the bottom tip portion 2. Optionally, the front surface structure of bottom tip portion 2 mirrors the rear surface of bottom tip portion 2, so that, for example, protrusion 4*a* are formed both on the front and rear surface of the bottom tip portion 2 as seen in FIG. 1*b*.

Figure 2A:
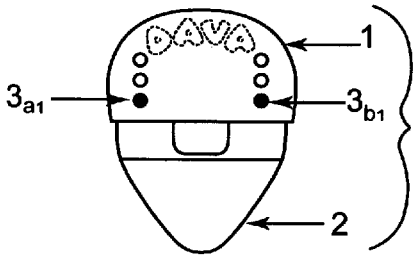
FIG. 2*a* is an illustration of the two-part pick of the invention as the bottom tip portion is partially inserted into the top grip portion.
Figure 2B:
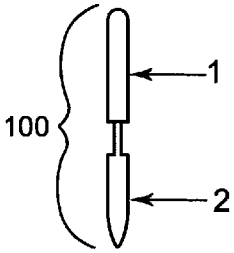
FIG. 2*b* is side view of FIG. 2*a;*

In use, legs 9*a*, 9*b* of the bottom tip portion 2 are adapted to be slideably inserted into the corresponding slots 5*a*, 5*b* of the top grip portion so that protrusions 4*a*, 4*b* may selectively engage corresponding holes $\mathbf{3}_{ax}$, $\mathbf{3}_{bx}$ in the top grip portion. Stated differently, the second engagement means is adapted to selectively engage the first engagement means to define a flexible pick 100. Thus, those of skill in the art will realize that if protrusions 4*a*, 4*b* engage a first set of holes $\mathbf{3}_{a1}$, $\mathbf{3}_{b1}$ (as illustrated in FIGS. 2*a*, 2*b*), the overall pick 100 structure achieves a maximum height, and in this embodiment, the pick achieves its maximum flexibility due to the flexibility provided by legs 9*a*, 9*b* in relation to the top grip portion 1. In this embodiment, the pick 100 will have its most flexible characteristics because each leg 9 provides a substantial amount of flex when the pick is used to play a stringed instrument.

Figure 4A:
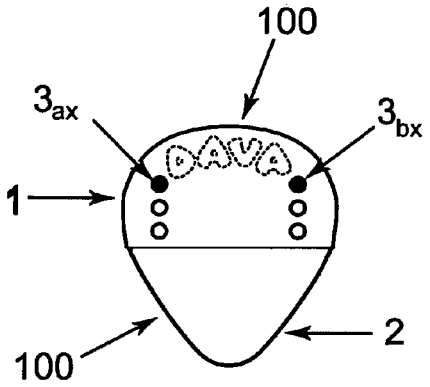
FIG. 4*a* is an illustration of the two-part pick of the invention as the bottom tip portion fully (or, completely) inserted into the top grip portion.
Figure 4B:
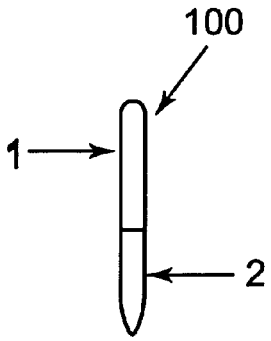
FIG. 4*b* is side view of FIG. 4*a;*
Figure 5:
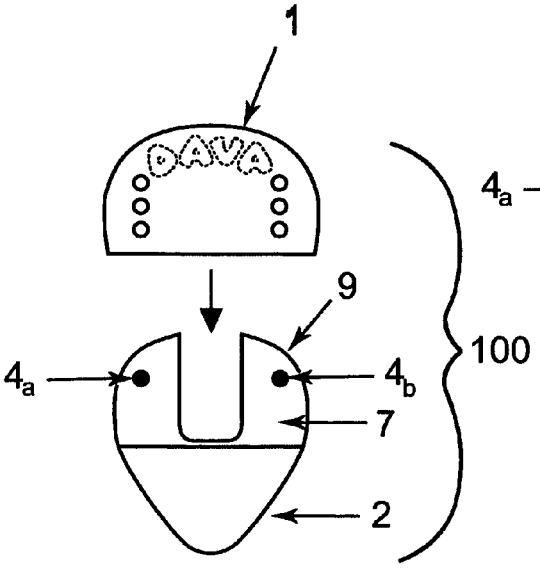
FIG. 5 identifies the bottom tip portion completely separated from the top grip portion, at least one of the bottom tip portion legs having one or more protrusions formed thereon (illustrated as a solid circle), and the top grip portion having one or more holes (illustrated as a lined circle), slots or channels as part of one embodiment of the engagement means for selective engagement with each protrusion. This illustration shows the present invention disengaged.

Because one or more holes $\mathbf{3}_{ax}$, $\mathbf{3}_{bx}$ may be formed in the top grip portion 1, those of skill in the art will also realize that the pick may selectively achieve various flexibilities and height depending upon how each protrusion 4*a*, 4*b* engages each hole $\mathbf{3}_{ax}$, $\mathbf{3}_{bx}$. Thus, for example, if protrusions 4*a*, 4*b* engage a last set of holes $\mathbf{3}_{ax}$, $\mathbf{3}_{bx}$ (as illustrated in FIGS. 4*a*, 4*b*), the overall pick 100 structure achieves a minimum height, and in this embodiment, the pick achieves its minimum flexibility due to the lack of flexibility provided by legs 9*a*, 9*b* in relation to the top grip portion 1. In this embodiment, the overall pick structure 100 may provide little to no flexibility in the pick 100 when the pick is used to play a stringed instrument.

Optionally, the front surface structure of top grip portion 1 mirrors the rear surface of top grip portion, so that, for example as shown in FIG. 1*b*, protrusions 4*a* may appear on both surfaces of legs 9*a*. Moreover, in a preferred embodiment, each hole $\mathbf{3}_{ax}$, $\mathbf{3}_{bx}$ formed may be in spatial communication with some portion of each slot 5*a*, 5*b*. Thus, for example as seen in FIG. 1*c*, the unnumbered holes on the left side of top grip portion 1 have a space therethrough that communicates with the slot space formed on the left slot numbered as 5*a*. Similarly as shown in FIG. 1*c*, holes $\mathbf{3}_{bx}$ on the right side of top grip portion 1 have a space therethrough that communicates with the slot space formed on the right slot 5*b*.

Those of skill in the art will now appreciate that numerous types of engagement means may be used in order to engage the top grip portion 1 to the bottom tip portion 2, and the specific types of engagement means disclosed herein are merely exemplary, and are not limiting in any fashion.

Those of skill in the art will now appreciate that the present invention provides a device for a variety of differing pick flexibilities, depending on how the musician selectively changes how each protrusion (e.g., 4*a*, 4*b*) on each leg (e.g., 9*a*, 9*b*) engages corresponding holes (e.g., $\mathbf{3}_{ax}$, $\mathbf{3}_{bx}$) in the top grip portion 1. At the pick's maximum height, the pick provides maximum flexibility in the overall pick structure. At the pick's minimum height, the pick provide little to no flexibility in the overall pick structure. And, those of skill in the art will realize that when the pick is arranged somewhere between its maximum and minimum height, various flexibilities in the overall pick structure are immediately available to a musician, so that the musician may change the pick's flexibility immediately and without having to switch picks.

During play of an instrument's strings, the musician can vary the grip of the pick. When a louder tone is needed in any given passage, the thumb and index finger are positioned in order to encompass the whole of the tip portion of the pick, allowing for more attack of the plucked string or strings. As the musician rolls the thumb and index finger back, he starts to expose an intermediate tip portion of the pick. As this intermediate portion is exposed, the pick becomes more and more flexible. When the musician holds mainly the top grip portion 1 of the pick and the full intermediate tip portion is exposed, the pick becomes very flexible. This may be preferred for rhythm playing and speed picking. By moving the thumb and index finger in small degrees, any desired amount of flexibility of the present invention is instantly available for any given note of a passage. By shortening the space between the top grip portion and the bottom tip portion in varying degrees, a musician can tighten the flexibility of the pick, thereby making the thumb and index finger control more sensitive. When the top grip portion 1 and the bottom tip portion 2 are closed together completely, this shuts off the flexibility so the pick has a very stiff and solid feel.

The top grip portion and the bottom tip portion are both preferably molded from a single (or same) material, however, the tip portion may also include a different material.

Figure 3:
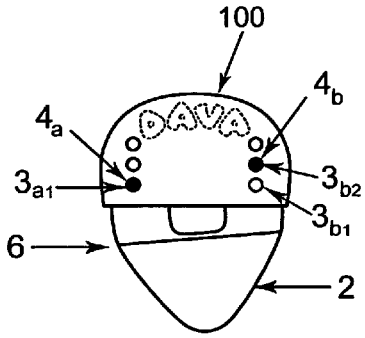
FIG. 3 is an illustration of the two-part pick of the invention as the bottom tip portion may be further partially inserted at an angle into and relative to the top grip portion.

There are further benefits of the present invention which are not found in the prior art. Namely, the present pick 100 may be adapted to provide angular adjustment by varying how the first engagement means engages the second engagement means. As illustrated in FIG. 3, a exemplary pick 100 is shown wherein the first engagement means engages the second engagement means at an angle. In this embodiment, a protrusion 4*a* from leg 9*a* engages a hole $\mathbf{3}_{a2}$ while protrusion 4*b* engages a non-corresponding hole $\mathbf{3}_{b1}$ which results in the top grip portion 1 being angularly adjusted in relation to the bottom tip portion 2. The exemplary type of pick structure illustrated in this embodiment may be important to some musicians, because as noted previously, some musicians like to hold a pick at an angle to the string in order to "slice" a note in order to slide over the strings while playing a chord. The adjustment in the pick's angularity in relation to a string on the instrument allows a musician to adjust the pick's tip at an angle relative to the top grip portion.

Figure 7A:
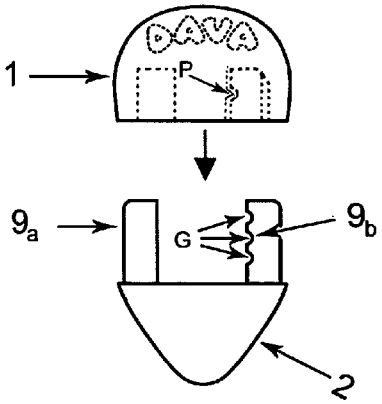
FIG. 7*a* is alternate embodiment showing one or more grooves in the legs of the bottom tip portion, and one or more protuberances in the top grip portion.
Figure 7B:
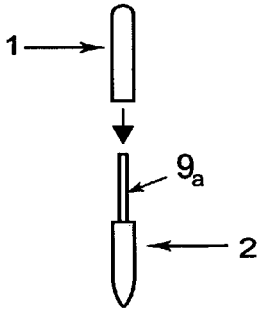
FIG. 7*b* is a side view of FIG. 7*a;*
Figure 8:
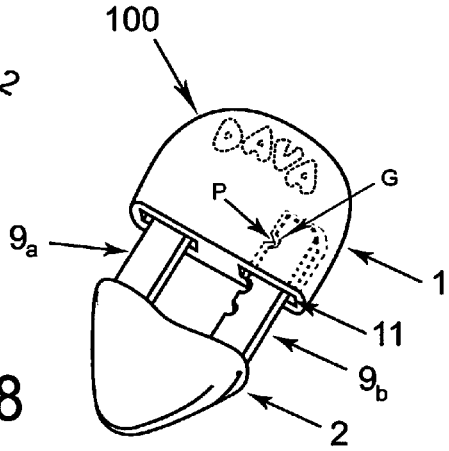
FIG. 8 illustrates another embodiment of the engagement means of the present invention, namely, the bottom tip portion having at least one leg containing at least one groove, and wherein the top grip portion has at least one protuberances formed therein, each protuberances adapted to selectively engage each groove as desired by the musician when the present invention is selectively height adjusted.

As noted previously, other types of first and second engagement means are available to construct the pick of the present invention, and still remain with the scope of the present invention. Thus, for example, as seen in FIGS. 7*a*-8, a different type of engagement means are illustrated for exemplary purposes. In this embodiment, pick 100 includes a top grip portion 1 and a bottom tip portion 2. In this embodiment, the top grip portion 1 has formed within its body at least one channel 11. Further in this embodiment, the bottom tip portion has at least one leg (e.g., 9*a*, 9*b*). Any one of the channels 11 may further include one or more protuberances P at selected distances along the channel, and any one of the legs (e.g., 9*a*, 9*b*) may have formed thereon one or more grooves G so that the protuberances are adapted to selectively engage any of the grooves G. Thus, for example as shown in FIG. 8, a pick 100 is illustrated at a maximum height, and in this embodiment, the pick achieves its maximum flexibility due to the flexibility provided by legs 9*a*, 9*b* in relation to the top grip portion 1. In this embodiment, the pick 100 will have its most flexible characteristics because each leg provides a substantial amount of flex when the pick is used to play a stringed instrument.

Figure 6A:
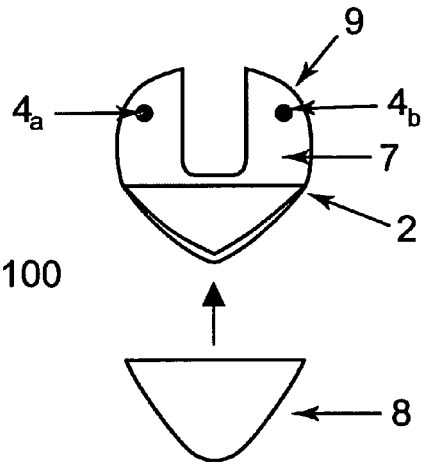
FIGS. 6*a* and 6*b* illustrate two different embodiments of an optional insertable tip for the present invention.
Figure 6B:
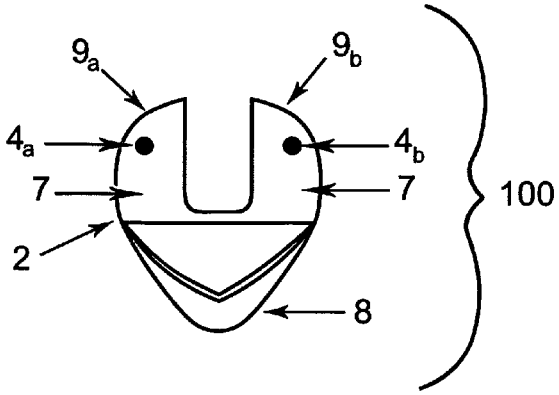
Figure 6C:
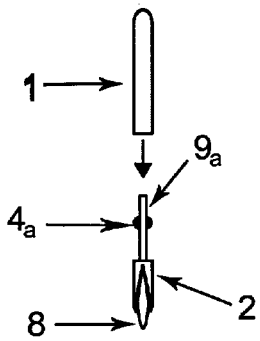
FIG. 6*c* is a side view of FIG. 6*b;*

In an alternate embodiment, as seen by example in FIGS. 6*a*-6*c*, a different striking surface or affixable cap 8 can be removably insertable onto the bottom tip portion's 2 far end. The optional different striking surface 8 may be formed from of any type of material, including steel, plastic, nylon, delrin or any other material or combination thereof without limitation.

While the scope of the present invention should not be limited to any particular theory of operation, it should be instructive to speculate on such in order to provide the reader with a full understanding of this invention and its preferred embodiment.

Various modifications to the present invention will become apparent to those skilled in the art from the foregoing description and accompanying drawings. Accordingly, the present invention is to be limited solely by the scope of the following claims.

As will be appreciated by one of ordinary skill in the art, the present invention may be embodied as a system, method, process or apparatus, or any combination thereof. Additionally, in the foregoing specification, the invention has been described with reference to specific embodiments. However, it will be appreciated that various modifications and changes can be made without departing from the scope of the present invention as set forth in the claims below. The specification and figures are to be regarded in an illustrative manner, rather than a restrictive one, and all such modifications are intended to be included within the scope of present invention. Accordingly, the scope of the invention should be determined by the appended claims and their legal equivalents, rather than by the examples given above. For example, the steps recited in any of the method or process claims may be executed in any order and are not limited to the order presented in the claims.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical".

Other variations and modifications of the present invention will be apparent to those of ordinary skill in the art, and it is the intent of the appended claims that such variations and modifications be covered. The particular values and configurations discussed above can be varied, are cited to illustrate representative embodiments of the present invention and are not intended to limit the scope of the invention. It is contemplated that the use of the present invention can involve components having different characteristics as long as the principle is followed.

I claim:

1. An adjustable plectrum for use in playing a string instrument, the plectrum comprising a top grip portion and a bottom tip portion, the top grip portion having a first engagement means, the bottom tip portion having a second engagement means, the first engagement means adapted to selectively engage the second engagement means resulting in the adjustable plectrum, the top grip portion further comprising at one set of left holes formed therethrough, and at lease one set of right holes formed therethrough, and at least one slot, the left holes, the right holes and each slot defining the first engagement means formed within the top grip portion.

2. The adjustable plectrum of claim 1, the bottom tip portion further comprising a narrow tip at a far end, and at least one leg at an opposite mating end.

3. The adjustable plectrum of claim 2, further comprising a different striking surface insertable onto the bottom tip portion's far end.

4. The adjustable plectrum of claim 3, each leg adapted for insertion and mating with each slot in the first engagement means.

5. The adjustable plectrum of claim 4, each leg further having at least one protrusion, each protrusion being adapted for selective insertion and mating with a corresponding left hole and right hole, each leg and protrusion defining the second engagement means.

6. The adjustable plectrum of claim 3, wherein each leg of the bottom tip portion is adapted to be slideably inserted into a corresponding slot of the top grip portion so that each protrusion may selectively engage a corresponding hole in the top grip portion to allow the plectrum to selectively achieve various heights and flex dependent upon how each protrusion engages each hole.

7. The adjustable plectrum of claim 1, the first engagement means adapted to selectively engage the second engagement means resulting in a height adjustable plectrum.

8. The adjustable plectrum of claim 1, the first engagement means adapted to selectively engage the second engagement means resulting in an angular adjustable plectrum.

9. The adjustable plectrum of claim 1, the first engagement means adapted to selectively engage the second engagement means resulting in a flex adjustable plectrum.

10. A height adjustable plectrum comprising for use in playing a string instrument, the height plectrum comprising a top grip portion with a body and a bottom tip portion, the top grip portion having a first engagement means, the bottom tip portion having a second engagement means, the top grip portion having formed within the body at least one channel, the bottom tip portion having at least one leg.

11. The height adjustable plectrum of claim 10 wherein each channel further includes one or more protuberances P at selected distances along the channel.

12. The height adjustable plectrum of claim 11 wherein each leg has formed thereon one or more grooves, the protuberances being adapted to selectively engage any of the grooves when the first engagement means adapted to selectively engage the second engagement means.

13. An adjustable plectrum for use in playing a string instrument, the plectrum comprising a top grip portion and a bottom tip portion, the top grip portion having a first engagement means, the top grip portion further comprising at one set of left holes formed therethrough, and at lease one set of right holes formed therethrough, and at least one slot, the left holes, the right holes and each slot defining the first engagement means formed within the top grip portion, the bottom tip portion having a second engagement means, the bottom tip portion further comprising a narrow tip at a far end, and at least one leg at an opposite mating end, the first engagement means adapted to selectively engage the second engagement means resulting in the adjustable plectrum.

14. The adjustable plectrum of claim 13, further comprising an affixable cap removeably insertable onto the bottom tip portion's far end.

15. The adjustable plectrum of claim 13, each leg adapted for insertion and mating with each slot in the first engagement means.

16. The adjustable plectrum of claim 15, each leg further having at least one protrusion, each protrusion being adapted for selective insertion and mating with a corresponding left hole and right hole, each leg and protrusion defining the second engagement means.

17. The adjustable plectrum of claim 16, wherein each leg of the bottom tip portion is adapted to be slideably inserted into a corresponding slot of the top grip portion so that each protrusion may selectively engage a corresponding hole in the top grip portion to allow the plectrum to selectively achieve various heights and flex dependent upon how each protrusion engages each hole.

18. The adjustable plectrum of claim 13, the first engagement means adapted to selectively engage the second engagement means resulting in a height adjustable plectrum.

19. The adjustable plectrum of claim 13, the first engagement means adapted to selectively engage the second engagement means resulting in a height and flex adjustable plectrum.

* * * * *